US009651048B2

(12) United States Patent
Foerster

(10) Patent No.: US 9,651,048 B2
(45) Date of Patent: May 16, 2017

(54) GAS INLET VALVE FOR A COMPRESSOR, COMPRESSOR COMPRISING A GAS INLET VALVE OF THIS TYPE AND METHOD FOR OPERATING A COMPRESSOR COMPRISING A GAS INLET VALVE OF THIS TYPE

(71) Applicant: KAESER KOMPRESSOREN SE, Coburg (DE)

(72) Inventor: Andreas Foerster, Doerfles-Esbach (DE)

(73) Assignee: KAESER KOMPRESSOREN SE, Coburg (DE)

( * ) Notice: Subject to any disclaimer, the term of this patent is extended or adjusted under 35 U.S.C. 154(b) by 766 days.

(21) Appl. No.: 13/655,259

(22) Filed: Oct. 18, 2012

(65) Prior Publication Data

US 2013/0136638 A1 May 30, 2013

(30) Foreign Application Priority Data

Oct. 19, 2011 (DE) ..... 10 2011 084 811

(51) Int. Cl.
*F04C 28/06* (2006.01)
*F04C 29/12* (2006.01)
(Continued)

(52) U.S. Cl.
CPC ..... *F04C 29/126* (2013.01); *F04C 28/06* (2013.01); *F04C 28/26* (2013.01); *F04C 29/124* (2013.01); *F04C 18/16* (2013.01); *F04C 2270/58* (2013.01)

(58) Field of Classification Search
CPC ..... F04B 49/022; F04B 49/03; F04B 49/225; F04B 2205/01; F04B 2205/08;
(Continued)

(56) References Cited

U.S. PATENT DOCUMENTS 5,018,947 A 5/1991 Tsuboi
5,411,375 A * 5/1995 Bauer ..... F04C 18/16 137/492.5
(Continued)

FOREIGN PATENT DOCUMENTS

DE 68904263 T2 5/1993
DE 60210088 T2 9/2006
(Continued)

*Primary Examiner* — Patrick Hamo
(74) *Attorney, Agent, or Firm* — Maginot, Moore & Beck LLP

(57) ABSTRACT

A gas inlet valve (1) for a compressor (64), comprising: a housing (2); a valve device (6) arranged between a gas inlet portion (3) and a gas outlet portion (4), a valve body (57) resting against a valve seat (56) in a sealing manner when the valve device (6) is in a closed operating state, and the valve body (57) being lifted from the valve seat (56) when the valve device (6) is in an open operating state; a piston device (42) which comprises a first piston portion (43) and a second piston portion (44) which is different from the first piston portion (43), the first piston portion (43) being displaceably guided in a first cylinder portion (22) of the housing (2) and the second piston portion (44) being displaceably guided in a second cylinder portion (27) of the housing (2) which is different from the first cylinder portion (22); and a piston rod (38) which is displaceably mounted in the housing (2) and mechanically couples the valve body (57) of the valve device (6) to the piston rod (38), a fluid line (39) putting a first cylinder chamber (49) of the first cylinder portion (22) in operative fluid communication with the gas outlet portion (4), it being possible to apply a control pressure to a second cylinder chamber (52) of the second cylinder portion (27) in order to lift the valve body (57) from the valve seat (56). A rotary compressor comprising a gas inlet valve (1) of this type and a method for operating a
(Continued)

compressor (64), in particular a rotary compressor, comprising a gas inlet valve (1) of this type.

19 Claims, 5 Drawing Sheets

(51) Int. Cl.
*F04C 28/26* (2006.01)
*F04C 18/16* (2006.01)

(58) Field of Classification Search
CPC ..... F04C 28/06; F04C 28/24; F04C 29/124; F04C 2270/01; F04C 2270/58; F16K 15/18; F16K 17/168
See application file for complete search history.

(56) References Cited

U.S. PATENT DOCUMENTS

| | | | | |
|---|---|---|---|---|
| 6,431,210 | B1 | 8/2002 | Lowe et al. | |
| 7,316,546 | B2 | 1/2008 | Daniëls et al. | |
| 7,607,899 | B2 * | 10/2009 | Van Praag | F04B 49/225 417/440 |

FOREIGN PATENT DOCUMENTS

| | | | | |
|---|---|---|---|---|
| DE | 60307662 | T2 | 8/2007 | |
| EP | 2584200 | A2 * | 4/2013 | F04C 28/06 |
| GB | 385801 | A | 1/1933 | |

* cited by examiner

GAS INLET VALVE FOR A COMPRESSOR, COMPRESSOR COMPRISING A GAS INLET VALVE OF THIS TYPE AND METHOD FOR OPERATING A COMPRESSOR COMPRISING A GAS INLET VALVE OF THIS TYPE

FIELD OF THE INVENTION

The present invention relates to a gas inlet valve for a compressor, in particular for a rotary compressor, comprising a gas inlet valve of this type and to a method for operating a compressor, in particular a rotary compressor, comprising a gas inlet valve of this type.

BACKGROUND OF THE INVENTION

Although the present invention is applicable to any compressors, the present invention and the problem on which it is based will be described in detail in relation to a rotary compressor.

A compressor is usually driven by a transducer in a directly coupled manner or via a gearing and compresses a medium, in particular a gas, preferably air, as soon as the compressor is set in movement. However, this mode of operation has some drawbacks with regard to establishing a compressed air network. In a modern industrial plant, compressed air is used for many different applications. Depending on the number of loads connected to the compressed air network, the compressed air requirement increases or decreases. In order to maintain the required pressure level, the compressor would therefore switch continuously between full load and standstill. Control of this type would have a negative effect on the service life of all driven and driving components. Added to this is the increased power consumption in the start phase, which has an equally negative effect on the operating costs. In order to counteract this, various types of control are used in compressors. The function thereof is to minimise the energy consumption and wear and to maximise the availability. A control unit in what is known as a screw-type compressor can be what is known as a gas inlet valve. This is connected upstream of the compressor block of the compressor. The gas inlet valve is intended to allow a non-return function, in which backflow of gas and/or fluid from the compressor into the environment of the compressor is prevented, no-load control and full-load control and/or proportional control.

In the case of no-load control of the compressor, the gas inlet valve may allow only a particular amount of air or process gas into the compressor. This measure can be explained as follows. The start-up of the compressor involves an increased energy requirement as measured at full-load operation owing to the mass inertia of the moved components. In order to minimise these peak loads, it helps to minimise the work which is carried out during compression of the medium, by reducing the incoming air flow to a minimum amount. For this purpose, the gas inlet valve comprises a spring-biased valve body. For switching from no-load operation to full-load operation, this body is lifted from the valve seat, against the spring force of a spring which presses the valve body against its valve seat, by means of a pressurised piston. A gas inlet valve of this type comprising a spring-biased valve body is disclosed, for example, in DE 602 10 088 T2 or in U.S. Pat. No. 6,431,210 B1. However, this construction of the gas inlet valve has proven disadvantageous in that the valve spring, which presses the valve body against the valve seat when the compressor is in the no-load operating state, must be very powerfully dimensioned and thus requires particular care during disassembly and assembly. Owing to the high spring bias, work on the valve spring involves an extremely high risk of injury.

In order to avoid this, DE 603 07 662 T2, for example, proposes a gas inlet valve in which a large valve spring of this type can be dispensed with. For this purpose, a double piston which can be pressurised on two sides is exposed, on the side remote from the gas outlet of the gas inlet valve, to the negative pressure applied to the gas outlet of the gas inlet valve and, on the opposite side, to a control pressure, in order to press the valve body against its valve seat. However, this requires a complex, finely adjusted and thus fault-prone pneumatic system in order to ensure reliable operation of the gas inlet valve.

DE 689 04 263 T2 discloses a screw-type vacuum pump which contains a pump housing comprising suction and pressure openings on the opposing sides thereof; interlocking outer and inner rotors which contain means for pumping a gas from the suction opening when the rotors are rotated; a force transmission means for rotating the rotors, which contains a gear box comprising an oil tank; oil circulation means, which contain an oil pump and an oil cooler, for circulating lubricating oil to the pump housing to lubricate the rotors; and a stop valve which communicates with the suction opening and comprises a valve housing which defines a gas flow space and a cylinder space, the gas flow space being isolated from the cylinder space in terms of flow and comprising a valve seat, and a valve body which is normally pressed in the closed position in order to close the valve seat and close the suction opening, the valve body including a piston which is fitted into the cylinder space in order to divide the cylinder space into an oil chamber and an air chamber at atmospheric pressure, a three-way changeover valve being provided which selectively connects the oil chamber to the oil tank via a relief path when the vacuum pump is stopped and to the oil circulation means in a position downstream of the oil pump when the vacuum pump is in operation.

DE 603 07 662 T2 discloses a compressor containing a compressor element which is provided with a rotor chamber, to which an inlet pipe and an outlet pipe are connected, a tank in the outlet pipe and a pressure control system which comprises an inlet valve positioned in the inlet pipe, a piston which is connected to the inlet pipe and can be moved in a cylinder, a bypass which bypasses said inlet valve and in which are positioned in succession, between the inlet pipe and the rotor chamber, a gas flow limiter and a non-return valve which allows only gas into the rotor chamber, and a gas pipe which connects the tank to the part of the bypass which is located between the gas flow limiter and the non-return valve, and a relief valve positioned in said gas line.

DE 602 10 088 T2 discloses a volumetric compressor which comprises a compressor element comprising a compression space to which an inlet line, which can be closed by means of an inlet valve, and a pressure line, in which a pressure vessel is installed, are connected, the inlet valve comprising a valve element which cooperates with a valve seat, said element being connected to a piston which can be displaced in a hollow space in a cylinder-forming housing, and a resilient element which presses this valve element towards the valve seat, while a control line connects the interior of the pressure vessel to a cylinder chamber formed between the operative side of the piston and the housing.

U.S. Pat. No. 6,431,210 B1 discloses an inlet valve for a gas compressor, the inlet valve comprising a piston which can be moved in a housing chamber and can be moved towards and away from a housing inlet. A valve disc can be moved by means of the piston, the valve disc comprising an opening for controlling an air flow from the housing inlet into the housing chamber. The inlet valve further comprises a flexible component which cooperates with the valve disc to close the opening.

GB 385 801 A discloses an arrangement for automatically starting up a compressor, in particular for starting up under no load. During start-up of the compressor, a start valve keeps the suction line closed. The start valve is held in its closed operating state by the pressure of a spring. The valve opens when the compressor is in operation, since the resulting negative pressure acts directly on the valve.

SUMMARY OF THE INVENTION

The object of the present invention is now to overcome the above-mentioned drawbacks and to provide an improved gas inlet valve in comparison to the prior art.

According to the invention, this object is achieved by a gas inlet valve having the features of claim 1, by a compressor having the features of claim 12 and/or by a method having the features of claim 13.

Accordingly, a gas inlet valve for a compressor, in particular for a rotary compressor, is provided, comprising: a housing which comprises a gas inlet portion for drawing in a gas and a gas outlet portion for conveying the drawn-in gas to a compressor block of the compressor, which gas outlet portion can be put in operative fluid communication with the gas inlet portion as needed; a valve device which is arranged between the gas inlet portion and the gas outlet portion and comprises a valve body and a valve seat, the valve body resting against the valve seat in a sealing manner when the valve device is in a closed operating state, and the valve body being lifted from the valve seat when the valve device is in an open operating state; a piston device which comprises a first piston portion and a second piston portion which is different from the first piston portion, the first piston portion being displaceably guided in a first cylinder portion of the housing and the second piston portion being displaceably guided in a second cylinder portion of the housing which is different from the first cylinder portion; and a piston rod which is displaceably mounted in the housing and mechanically couples the valve body of the valve device to the piston device, a fluid line putting a first cylinder chamber of the first cylinder portion in operative fluid communication with the gas outlet portion, it being possible to apply a control pressure to a second cylinder chamber of the second cylinder portion in order to lift the valve body from the valve seat.

A compressor, in particular a rotary compressor, comprising a gas inlet valve of this type is also provided.

A method for operating a compressor, in particular a rotary compressor, comprising a gas inlet valve according to any of the preceding claims is also provided, comprising the following method steps: starting a drive motor of the compressor and producing a negative pressure in the gas outlet portion of the gas inlet valve, the valve device being closed; opening the bypass device in a pressure-controlled manner by means of the negative pressure prevailing in the gas outlet portion in order to convey the drawn-in gas from the gas inlet portion to the gas outlet portion via the bypass device; compressing the drawn-in gas in the compressor block; isolating a working pressure supply line between a pressure space of the compressor and a second cylinder chamber of the gas inlet valve; and opening the valve device by means of the pressurised second cylinder chamber.

The idea underlying the present invention consists in configuring the piston device such that it comprises a first piston portion and a second piston portion which is different from the first piston portion.

The gas pressure present in the gas outlet portion is continuously applied to the first cylinder chamber via the fluid line. Since the valve body is coupled to the piston device via the piston rod, the valve body is pressed against the valve seat thereof in the no-load operating state by a negative pressure prevailing in the gas outlet portion. A powerfully dimensioned valve spring for implementing the no-load operating state can thus be dispensed with. In addition, a working pressure needs to be applied only to the second cylinder chamber in order to open the valve device. A complex and finely adjusted pneumatic system is thus not required for reliable operation of the gas inlet valve.

Advantageous configurations and developments of the invention are found in the further dependent claims and in the description in conjunction with the figures of the drawings.

According to a preferred configuration of the gas inlet valve, the piston rod comprises the fluid line, the fluid line being designed in particular as a fluid conduit extending in the piston rod. The fluid line is preferably designed as a through-hole extending centrally in the piston rod. Alternatively, the fluid line is designed as a fluid conduit extending in the housing, in particular in a wall of the housing. Providing the fluid line in the piston rod results in a particularly short flow path having a low flow resistance. Providing the fluid line in the housing means that the piston rod can be produced particularly cost-effectively.

According to a preferred configuration of the gas inlet valve, said valve comprises a spring device which spring-biases the piston device in the direction of a housing cover of the housing. In particular, the spring device is arranged between the piston device and a counter face of the housing (valve dome), the spring device spring-biasing the valve body against its valve seat via the mechanical coupling of the piston device and the valve body by means of the piston rod. As a result, when the compressor is in the standstill state it is ensured that the valve device is completely closed. As a result, it is possible to position the movable components of the gas inlet valve vertically, thereby reducing wear of the bearing points. The spring device is preferably designed to carry at least a dead weight of the piston device and the piston rod. In particular, the spring device can be designed also to carry a dead weight of the valve body and/or of a spring of the valve device. As a result, a spring device having a low spring rigidity can be selected and mounted with a low spring preload. Mounting the spring device is simplified as a result.

According to a preferred embodiment of the gas inlet valve, said valve comprises a bypass device which puts the gas inlet portion in operative fluid communication with the gas outlet portion, bypassing the closed valve device, as needed, in particular when the gas inlet valve is in a no-load operating state, the bypass device preferably being designed to operate according to the operating principle of a non-return valve. In the no-load operating state a required (small) no-load air quantity is drawn in via the bypass device. This makes it possible, by a simple technical measure, to supply a reduced incoming air flow during no-load operation of the compressor. The construction of the gas inlet valve is simplified as a result.

According to another preferred embodiment, an active surface of the first piston portion is larger than an active surface of the second piston portion. The active surface of the first piston portion is preferably at least 15 times larger than the active surface of the second piston portion. In particular, the active surface of the first piston portion is 30 times larger than the active surface of the second piston portion. In particular, the active surface of the first piston portion corresponds to 0.7 to 1.5 times, in particular 1 to 1.1 times an active surface of the valve body. The active surface of the first piston portion preferably corresponds to 1.05 times the active surface of the valve body. By adapting the active surfaces to one another, the spring device can advantageously be made as small as possible, thereby reducing the cost of assembling the gas inlet valve.

According to another preferred configuration of the gas inlet valve, an active surface of the first piston portion and an active surface of the valve body are dimensioned in such a way that the valve device remains in its closed operating state when the second cylinder chamber is deaerated, irrespective of an operating state of the compressor, owing to forces acting on the first piston portion and the valve body and owing to a spring force of the spring device acting on the valve body. The compressor can for example be in a load, no-load or standstill operating state. In particular, the valve device can be opened only by applying a control pressure to the second cylinder chamber. As a result, the valve device is always in its closed operating state when the second cylinder chamber is in a deaerated state.

According to another preferred configuration of the gas inlet valve, the valve body is displaceably mounted on the piston rod. In the event of a sudden interruption of the compression process performed by the compressor, for example in an emergency shutdown operating state thereof, a pressure builds up below the valve body (backflow) in a time-delayed manner. Because the valve body is displaceably mounted on the piston rod, said valve body is lifted in fractions of a second over its entire stroke in the direction of the valve seat and pressed against the valve seat of the valve device owing to the prevailing pressure in the gas outlet portion. As a result, a non-return function is implemented, which reliably prevents gas and/or oil from flowing from the gas outlet portion back into the gas inlet portion.

According to a preferred embodiment of the gas inlet valve, the valve device comprises a spring which is arranged between the valve body and a limiting element of the piston rod. In particular, the spring is designed to carry a dead weight of the valve body. In the illustrated case of a block standstill, that is to say the sudden interruption of the compression process, the flow from the suction filter of the compressor through the gas inlet valve to the compressor block breaks off. Before the compressed gas which flows back reaches the valve body, the spring has already lifted said valve body almost to the valve seat. When the non-return function sets in, the distance of the valve body from the valve seat is relatively small. The impact forces when the valve body hits the valve seat thus prove to be accordingly small. As a result, excessive wear of the valve body is prevented, thereby increasing the service life of the gas inlet valve.

According to a preferred embodiment of the method, the piston device is moved against a spring force of the spring device when the valve device is opened.

According to another preferred embodiment of the method, an active surface of the first piston portion and an active surface of the valve body are dimensioned in such a way that the valve device remains in its closed operating state when the second cylinder chamber is deaerated, irrespective of an operating state of the compressor, owing to forces acting on the first piston portion and the valve body and owing to a spring force of the spring device acting on the valve body and that the valve device can be opened only by applying a control pressure to the second cylinder chamber. As a result, the valve device is always brought into its closed operating state when the second cylinder chamber is in a deaerated state.

BRIEF DESCRIPTION OF THE DRAWINGS

The invention will be described in more detail by way of embodiments with reference to the appended figures of the drawings, in which.

In the figures of the drawings, like reference signs denote like or functionally like components, unless indicated otherwise.

DETAILED DESCRIPTION OF THE INVENTION

Figure 1:
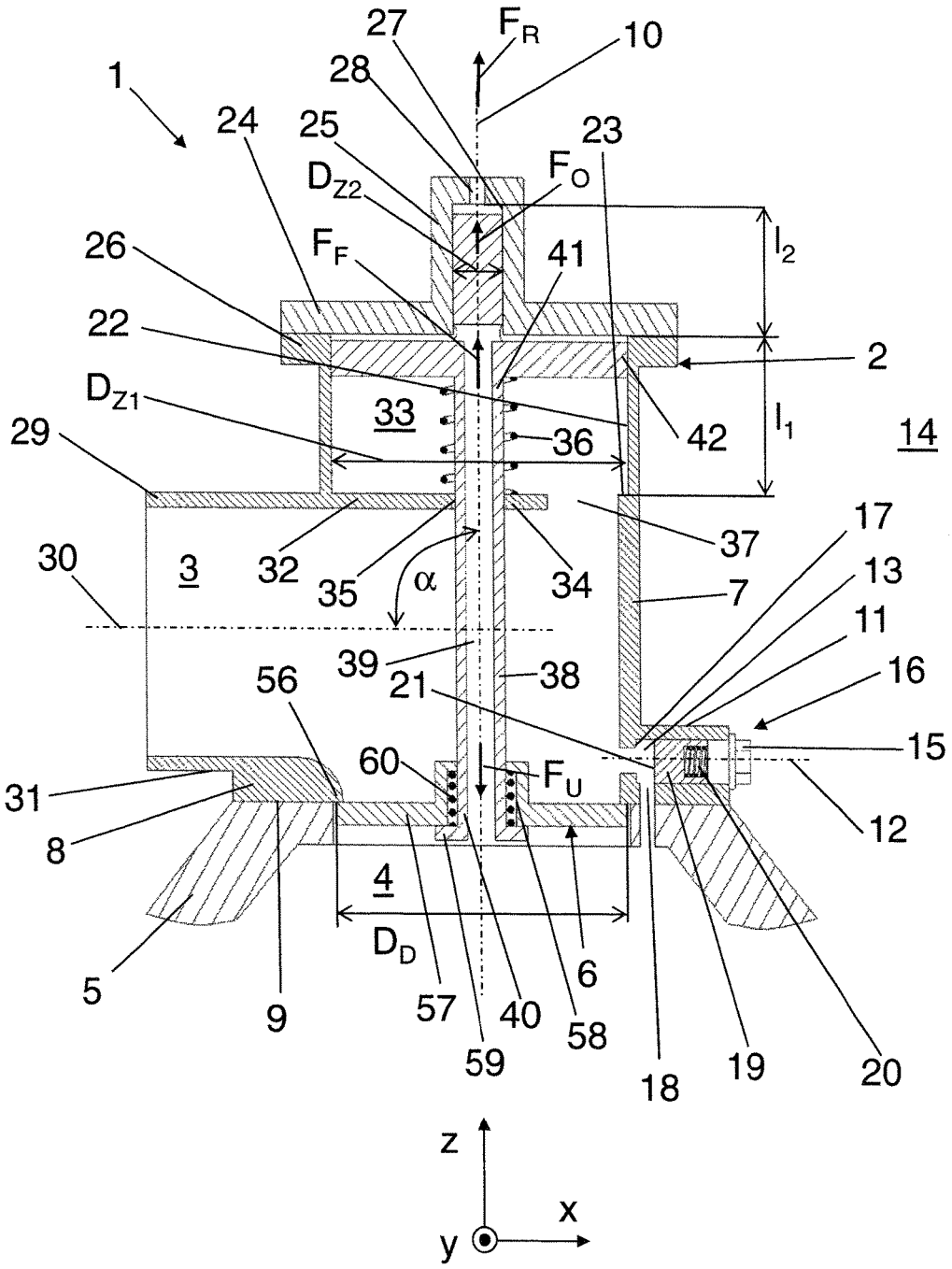
FIG. 1 is a cross-sectional view of a preferred embodiment of a gas inlet valve in a no-load operating state.

FIG. 1 shows a preferred embodiment of a gas inlet valve 1 for a compressor, in particular for a rotary compressor. For example, the compressor is designed as a screw-type compressor, sliding vane compressor, scroll compressor or the like, which is preferably driven by means of an electric motor or internal combustion engine. The compressor can for example be designed to be lubricated with fluid or to operate dry. The compressor preferably comprises a pressure space which is arranged downstream of a compressor block of the compressor. In a compressor lubricated with fluid, the pressure space can be designed as a fluid separation tank, in particular as an oil separation tank or as a water separation tank. In a compressor which operates dry, the pressure space can be designed for example as a portion of a pipe downstream of the first compressor stage. In the present case, the preferred embodiment of the gas inlet valve 1 will be described with reference to an oil-injected screw-type compressor. However, the gas inlet valve 1 described in the following is not limited to compressors of this type and can be used in any compressor construction.

The gas inlet valve 1 comprises a housing 2 comprising a gas inlet portion 3 and a gas outlet portion 4. The gas inlet portion 3 is designed to draw in a gas, for example ambient air. The gas can be uncompressed or already pre-compressed. The gas outlet portion 4 is designed to convey the gas drawn in by means of the gas inlet portion 3 on to a compressor block 5 of the compressor. The gas inlet portion 3 and the gas outlet portion 4 can be separated from each other fluidically by means of a valve device 6 arranged between the gas inlet portion 3 and the gas outlet portion 4 or be in fluid communication with each other.

The housing 2 preferably comprises a first hollow-cylindrical housing portion 7. The valve device 6 is preferably arranged at a first end portion of the first housing portion 7. The first housing portion 7 comprises a block connection flange 8 comprising a substantially annular screw-on surface 9. The screw-on surface 9 preferably rests flat against the face of the compressor block 5. The block connection flange 8 is operatively connected to the compressor block 5 with non-positive and/or positive locking by means of connecting elements. A sealing device, for example an O-ring, is preferably arranged between the screw-on surface 9 and the compressor block 5. The connecting elements are designed for example as screws. The screw-on surface 9 forms for example an x/y plane of the first housing portion 7 and of the housing 2, perpendicular to which plane a z axis or vertical direction of the housing 2 is positioned. A central axis 10 of the first housing portion 7 and of the housing 2 preferably extends in the z direction. The central axis 10 can alternatively be arranged at an angle of approximately 45° to 90° to the screw-on surface 9. Other installation positions of the compressor block and of the screw-on surface are also conceivable. The screw-on surface 9 can be arranged at any position of the first housing portion 7 and/or at any angle to the central axis 10 of the first housing portion 7.

The first housing portion 7 further comprises an optional hollow-cylindrical cast eye 11 which is integral with the first housing portion 7 and is preferably arranged in a lower region of the first cylinder portion 7, that is to say a region assigned to the gas outlet portion 4. The cast eye 11 can alternatively be arranged in any position on the housing 2. A central axis 12 of the cast eye 11 is preferably arranged perpendicular to the central axis 10 of the housing 2. The cast eye 11 is preferably provided with a central stepped hole 13 which extends along the central axis 12, cuts through the first cylinder portion 7 and connects the gas inlet portion 3 to the environment 14 of the inlet valve 1. To close the stepped hole 13 off from the environment 14 in a gas-tight manner, a screw plug 15 of a bypass device 16 which will be described below is provided. The stepped hole 13 preferably has a larger hole diameter in the cast eye 11 than in the first housing portion 7. On the outside of the first housing portion 7, that is to say towards the cast eye 11, the periphery of the stepped hole 13 is preferably provided with a valve seat 17. The stepped hole 13 is put in operative fluid communication with the gas outlet portion 4 by means of a further opening, in particular a hole 18, which extends substantially in the z direction.

The bypass device 16 preferably comprises, in addition to the hole 18, the stepped hole 13 and the screw plug 15, a substantially cylindrical valve piston 19 which is arranged displaceably in the stepped hole 13, and a spring 20, in particular a compression spring 20. The valve piston 19 is preferably spring-biased in the direction of the first housing portion 7 by means of the compression spring 20 arranged between said valve piston and the screw plug 15. When the bypass device 16 is in a closed operating state, a sealing portion 21 of the valve piston 19 rests in a sealing manner against the valve seat 17 of the stepped hole 13 and prevents gas flow from the gas inlet portion 3 to the gas outlet portion 4 via the bypass device 16. The compression spring 20 is preferably arranged, at least in portions, in a central recess of the valve piston 19. A spring rigidity of the compression spring 20 is preferably configured such that, under the effect of a predetermined gas pressure, the sealing portion 21 is lifted from the valve seat 17 of the stepped hole 13 against the spring force of the compression spring 20 and gas can thus flow from the gas inlet portion 3 to the gas outlet portion 4 via the bypass device 16. The predetermined gas pressure is formed by an overpressure in the gas inlet portion 3 compared to the gas outlet portion 4. If a gas pressure acts which is lower than the predetermined gas pressure, the compression spring 20 presses the sealing portion 21 of the valve piston 19 against the valve seat 17. For example, the bypass device 16 is in the closed operating state when an overpressure prevails in the gas outlet portion 4 compared to the gas inlet portion 3 or the same gas pressure prevails in the gas outlet portion 4 and in the gas inlet portion 3.

A first cylinder portion 22 is provided at a second end portion, remote from the first end portion, of the first housing portion 7. The first cylinder portion 22 is preferably provided as a machined surface in the hollow-cylindrical first housing portion 7. The first cylinder portion 22 preferably has a diameter $D_{Z1}$ and a length $l_1$. In a preferred embodiment of the gas inlet valve 1, a preferably peripheral shoulder 23 limits the first cylinder portion 22, in particular downwardly, that is to say in the direction of the valve device 6. The first cylinder portion 22 is limited upwardly by a housing cover 24 of the housing 2, which housing cover closes the first housing portion 7. The housing cover 24 is preferably disc-shaped with a central, approximately cylindrical arched portion 25, the central axis of which preferably corresponds to the central axis 10 of the first housing portion 7. Alternatively, the arched portion 25 can be arranged eccentrically in relation to the central axis 10. The housing cover 24 preferably rests on a connection flange 26 of the first housing portion 7 in an annular manner and is operatively connected thereto by means of connecting elements, in particular screws, preferably with non-positive and/or positive locking. To centre the housing cover 24 on the connection flange 26, said flange can preferably comprise a peripheral centring collar. A sealing device, for example an O-ring, is preferably provided between the housing cover 24 and the connection flange 26.

The housing cover 24 preferably comprises a cylinder hole which is arranged coaxially with the central axis 10, extends into the arched portion 25 and in particular is formed as a second cylinder portion 27 of the gas inlet valve 1. The second cylinder portion 27 can be formed by means of a bush, in particular a slide bush. The second cylinder portion 27 preferably penetrates the housing cover 24 to a depth $l_2$ from the side of the first housing portion 7. The second cylinder portion 27 of the gas inlet valve 1 has a diameter $D_{Z2}$. A working pressure supply hole 28 is provided centrally in relation to the cylinder hole and preferably cuts through the part of the arched portion 25 which the cylinder hole does not cut through.

A second, substantially hollow-cylindrical housing portion 29 of the housing 2 is preferably integral with the first housing portion 7 and penetrates it, preferably at least in portions. A central axis 30 of the second housing portion 29 is preferably positioned at an angle $\alpha$ to the central axis 10. The angle $\alpha$ has for example a value of approximately 90°, in particular approximately 60°. The second housing portion 29 is preferably designed such that a first end portion of the first housing portion 7 which projects therefrom is designed as a flange portion 31 for connecting a gas supply line to the gas inlet valve 1. The gas supply line can be mounted on the flange portion 31 for example by means of a clamp. A second end portion of the second housing portion 29 preferably transitions into the first end portion of the first housing portion 7. The second housing portion 29 is preferably designed, at least in portions, as a suction bend, in such a way that the gas supplied in the housing 2 from the gas inlet portion 3 is guided to the gas outlet portion 4 along a curved path and thus in a manner which is optimised in terms of flow. An upper wall portion 32 of the second housing portion 29 separates the gas inlet portion 3 from an inner space 33 of the first housing portion 7.

A valve dome 34, which in particular is cylindrical, is provided substantially centrally in the housing 2 and comprises a through-hole 35 which is central in relation to the first housing portion 7 and extends in the direction of the central axis 10. The valve dome 34 is preferably integral with the upper wall portion 32. A bush operating as a slide bearing can be pressed into the through-hole 35. The valve dome 34 is used in particular as a contact surface for a spring device 36 or spring 36, in particular a compression spring 36. Preferably in the turbulent region of the valve dome 34, an aperture 37 is provided which puts the inner space 33 in fluid communication with the gas inlet portion 3. Alternatively or additionally, the inner space 33 can be put in direct operative fluid communication with the environment 14 by means of an aperture. As a result, substantially the same gas pressure always prevails in the inner space 33 and in the gas inlet portion 3. Substantially the same gas pressure should be understood to mean that there may be slight differences in pressure between the inner space 33 and the gas inlet portion 3. The housing 2, that is to say the housing portions 7, 29 and the housing cover 24 are preferably designed as cast components having machined functional surfaces. The housing portions 7, 29 are preferably formed in one piece.

A piston rod 38 is mounted in the housing 2, in particular in the valve dome 34, so as to be displaceable in the z direction, that is to say along the central axis 10. The piston rod 38 is preferably formed as a hollow cylinder comprising a central fluid line 39 which penetrates the piston rod 38, in particular over its entire length. The fluid line 39 is preferably designed as a fluid conduit which penetrates the piston rod 38 over its entire length, in particular as a through-hole. The gas outlet portion 4 is assigned a first end portion 40 of the piston rod 38. A second end portion 41 of the piston rod 38 is remote from the gas outlet portion 4. The fluid line 39 is in operative fluid communication with the gas outlet portion 4 in the region of the first end portion 40. The fluid line 39 can alternatively be designed as a fluid conduit extending in the housing 2, in particular in a wall of the housing 2.

Figure 2:
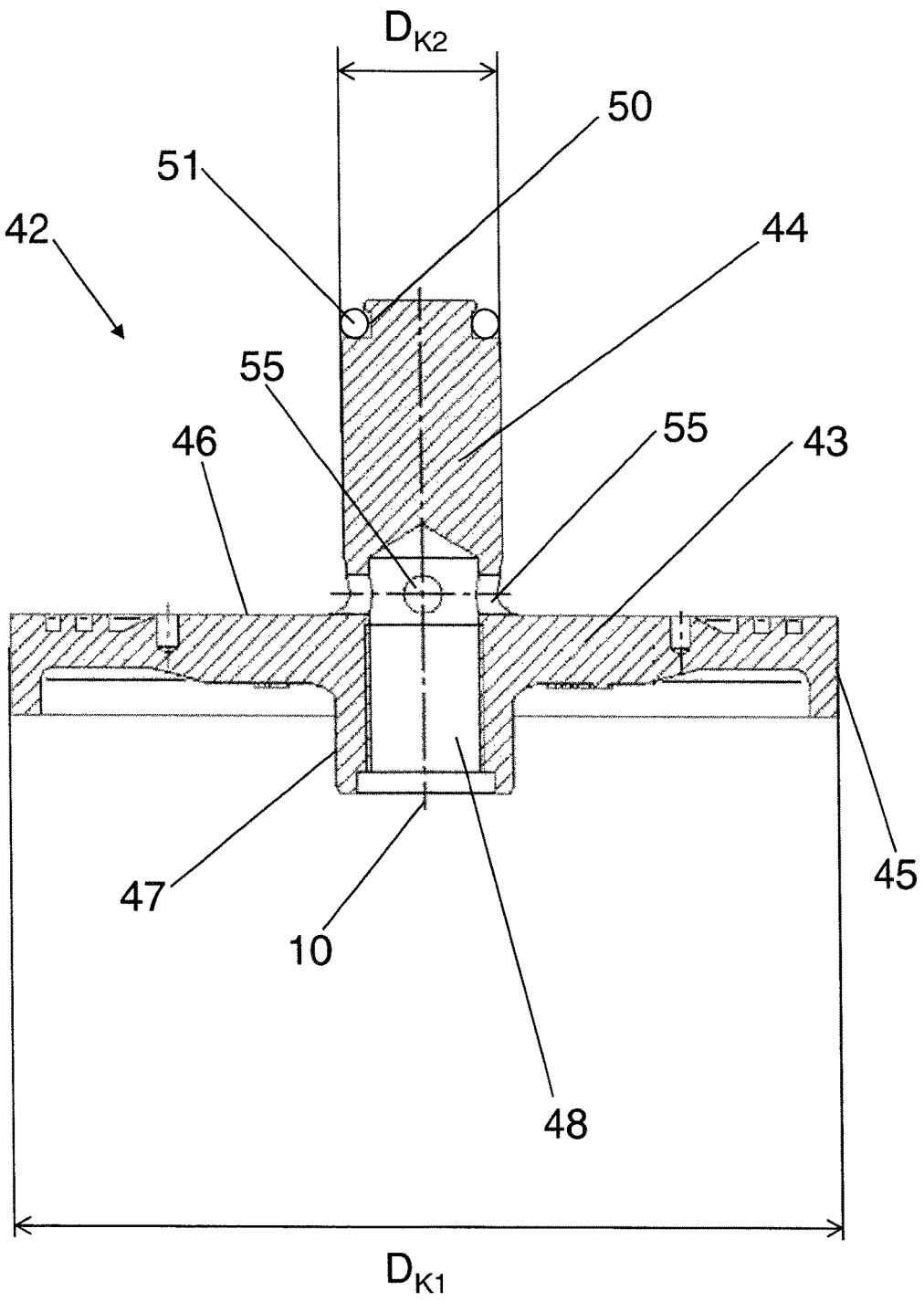
FIG. 2 is a cross-sectional view of a preferred embodiment of a piston device of the gas inlet valve according to FIG. 1.

The gas inlet valve 1 preferably comprises a piston device 42, shown in FIG. 2, comprising a first piston portion 43 and a second piston portion 44 which is different from the first piston portion 43. The first piston portion 43 is preferably substantially plate-shaped and is operatively connected in particular to the first cylinder portion 22. The first piston portion 43 can preferably slide back and forth in the z direction along the first cylinder portion 22. The maximum displacement of the first piston portion 43 in the direction of the gas outlet portion 4 is limited in particular by the shoulder 23. In an alternative but equally preferred embodiment of the gas inlet valve 1, the maximum possible displacement of the first piston portion 43 downwards in the direction of the gas outlet portion 4 is limited by the valve dome 34 and/or by a shoulder provided on the piston rod 38. This shoulder can for example be designed such that it is applied to the valve dome 34 to limit the downward displacement of the first piston portion 43.

The displacement of the first piston portion 43 away from the gas outlet portion 4 in the direction of the housing cover 24 is limited in that the piston device 42 is coupled, by means of the piston rod 38 operatively connected thereto, to a valve body 57 of the valve device 6 via the first end portion 40 of said piston rod. The spring device 36 presses the piston device 42 towards the housing cover 24. As a result, the valve body 57 is spring-biased against a valve seat 56. Owing to the mechanical coupling of the valve body 57 to the piston device 42, by adjusting the length of the piston rod 42 appropriately it is possible to provide that the first piston portion 43 always has at least a minimum spacing from the housing cover 24. The first piston portion 43 preferably never touches the housing cover 24. Peripherally towards the first cylinder portion 22, the first piston portion 43 can be provided with a first labyrinth seal, in particular a transparent labyrinth seal, which is provided peripherally on an outer surface 45 of said first piston portion. Towards the housing cover 24, the first piston portion 43 can additionally or optionally be sealed by means of a peripheral second labyrinth seal. The second labyrinth seal can be designed as what is known as a full labyrinth seal, interconnected labyrinth chambers preferably being incorporated into an end face 46, facing the housing cover 24, of the first piston portion 43 and into the housing cover 24. The first piston portion 43 can alternatively or additionally be sealed in relation to the first cylinder portion 22 by an O-ring, piston ring, grooved ring or the like. A sealing device can be dispensed with if the fit between the first piston portion 43 and the first cylinder portion 22 is configured accordingly. The first piston portion 43 comprises a cylindrical connection portion 47 which extends in the direction of the valve dome 34 and comprises a central hole 48. The hole 48 can alternatively be arranged eccentrically. The hole 48 can preferably be provided with an internal thread which is in particular complementary to an external thread of the second end portion 41 of the piston rod 38. The piston rod 38 is rigidly connected to the piston device 43 by means of this threaded connection. Alternatively, the piston rod 38 can be integral with the piston device 42. It is important in the connection between the piston rod 38 and the piston device 42 that the fluid line 39 is in operative fluid communication with the hole 48. The hole 48 can be an integral component of the fluid line 39.

In particular the spring 36, which is preferably designed as a compression spring 36, is arranged between the first piston portion 43 and the valve dome 34. The spring 36 pushes the piston device 42 in the direction of the housing cover 24 for example with a predetermined spring force. In particular, the spring device 36 biases the valve body 57 of the sealing device 6 against its valve seat 56 via the mechanical coupling of the piston device 42 and the valve body 57 by means of the piston rod 38. The first piston portion 43 preferably does not touch the housing cover 24. The first piston portion 43 preferably has a diameter $D_{K1}$, which in particular is adapted to the diameter $D_{Z1}$ in such a way that the first piston portion 43 can preferably slide in the first cylinder portion 22 with little friction, little gas loss and as little play as possible. The first piston portion 43, together with the first cylinder portion 22, preferably forms a first cylinder chamber 49 (FIG. 3) of the first cylinder portion 22.

The second piston portion 44 is preferably formed as a cylinder which is coaxial with the first piston portion 43. The second piston portion 44 is what is known as a working piston of the gas inlet valve 1. The second piston portion 44 is in particular arranged on the end face 46, remote from the connection portion 47, of the first piston portion 43. The piston portions 43, 44 are preferably formed in one piece. The second piston portion 44 is preferably displaceably guided in the z direction in the second cylinder portion 27. The first piston portion 43 and the second piston portion 44 can preferably be displaced back and forth in the z direction only together. The second piston portion 44 preferably has a diameter $D_{K2}$ adapted to the diameter $D_{Z2}$ of the second cylinder portion 27. The second piston portion 44 is peripherally sealed in relation to the second cylinder portion 27 preferably by means of a sealing ring 51 which is received, at least in part, in a peripheral annular groove 50.

Alternatively, a grooved ring, a piston ring or the like can be used instead of the sealing ring 51. The second piston portion 44 can alternatively be sealed in relation to the second cylinder portion 27 in the same way as the first piston portion 43 using any technical measures. The second piston portion 44 and the second cylinder portion 27 form a second cylinder chamber 52 (FIG. 3) of the second cylinder portion 27. A working pressure can be applied to the second cylinder chamber 52 by means of a working pressure supply line or control line 53 (FIG. 3) which is connected to the working pressure supply hole 28. The working pressure supply line 53 is preferably in operative fluid communication with a pressurised pressure space 54 arranged downstream of the compressor block 5. Since in the present case the gas inlet valve 1 is described with reference to an oil-injected screw-type compressor, the pressure space 54 is preferably designed as an oil separation tank. The pressure space 54 can, in a water-injected compressor, be designed as a water separation tank or, in a compressor which operates dry, for example as a portion of a pipe downstream of the first compressor stage.

The inner space 33 can optionally be in operative fluid communication with the oil separation tank. A gas pressure prevailing in the oil separation tank is preferably released into the inner space 33 as needed. The diameter $D_{K1}$ of the first piston portion 43 is preferably larger than the diameter $D_{K2}$ of the second piston portion 44. In particular, an active surface, which can be pressurised, of the first piston portion 43 is larger than an active surface, which can be pressurised, of the second piston portion 44. The active surface of the first piston portion 43 is preferably at least twice the size of the active surface of the second piston portion 44. In particular, the active surface of the first piston portion 43 is approximately 6 times larger than the active surface of the second piston portion 44.

The hole 48 of the piston device 42 penetrates the first piston portion 43 preferably completely and extends, at least in portions, into the second piston portion 44. Transverse holes 55 which penetrate the second piston portion 44, in particular two transverse holes 55 which intersect each other at an angle of approximately 90°, are provided preferably perpendicular to the central axis 10 and in the z direction above the end face 46 and put the hole 48 in operative fluid communication with the first cylinder chamber 49. Alternatively, only one transverse hole 55 or any number or transverse holes 55, for example three or four, can be provided. Because the piston rod 38 comprises the fluid line 39, the first cylinder chamber 49 is always in operative fluid communication with the gas outlet portion 4 via the transverse holes 55, the hole 48 and the fluid line 39, that is to say approximately the same gas pressure always prevails in the first cylinder chamber 49 as in the gas outlet portion 4.

The valve device 6 is arranged between the gas inlet portion 3 and the gas outlet portion 4. The valve device 6 comprises a valve seat 56 comprising a preferably conical sealing surface which is in particular inclined towards the gas inlet portion 3. The valve seat 56 is preferably integral with the housing 2. When the valve device 6 is in a closed operating state, a sealing surface of a valve body 57 rests against the valve seat 56, preferably in a linear manner. This line is the sealing edge of the valve device 6 and, when said device is in the closed operating state, separates the gas inlet portion 3 fluidically from the gas outlet portion 4 arranged below it. The valve body 57 preferably rests against the valve seat 56 from the side of the outlet portion 4. The sealing device 6 preferably has a sealing diameter $D_D$ which corresponds in particular to the sealing edge. The diameter $D_{K1}$ of the first piston portion 43 is preferably larger than the sealing diameter $D_D$. In particular, an active surface, which can be pressurised, of the first piston portion 43 is larger than an active surface, which can be pressurised, of the valve body 57. The active surface of the first piston portion 43 is preferably 0.7 to 1.5 times larger than the active surface of the valve body 57. In particular, the active surface of the first piston portion can be 1.05 times larger than the active surface of the valve body 57.

The valve body 57 is preferably plate-shaped or disc-shaped. In order to obtain a harmonious flow profile around the valve body 57, the valve body 57 can alternatively be approximately in the shape of a bell which transitions into a cone shape at a lower end facing the gas outlet portion 4. A cone angle of the cone shape preferably corresponds to an inclination angle of the conical sealing surface of the valve seat 56.

The valve body 57 preferably comprises a central hole 58 in which an elongate, hollow-cylindrical bush, in particular a bearing bush, can be press-fitted. The valve body 57 is preferably mounted in the first end portion 40 of the piston rod 38 in a sliding manner by means of a clearance fit. The possible movability of the valve body 57 in the direction of the housing cover 24 is upwardly limited by the valve seat 56. A limiting element 59 provided on the first end portion 40 prevents the valve body 57 from sliding downwards on the piston rod 38 towards the outlet portion 4. The limiting element 59 can be designed for example as a peripheral shoulder on the first end portion 40 or as a threaded nut screwed to the first end portion 40. A spring 60 is arranged between the limiting element 59 and the valve body 57.

The spring 60 is preferably in the form of a compression spring 60. The valve body 57 of the valve device 6 is mechanically coupled to the piston device 42 by means of the piston rod 38. The piston device 42, the piston rod 38, the spring device 36 and the valve device 6 are preferably arranged in a vertical direction, that is to say in the z direction of the gas inlet valve 1.

When the compressor is at a standstill (not shown in the figures), substantially the same gas pressure, for example the ambient pressure, prevails in the gas inlet portion 3 and in the gas outlet portion 4. The spring 36 is preferably designed such that at least the dead weight of the piston rod 38, the piston device 42, the valve body 57, the spring 60, etc. and a spring force $F_F$, acting in the direction of the housing cover 24, of the spring 60 are compensated. In an alternative embodiment of the gas inlet valve 1, the spring 36 can be designed such that it carries only the dead weight of the piston device 42 and of the piston rod 38. This means that, when the compressor is at a standstill, the gas inlet valve 1 is unpressurised and the valve device 6 and the bypass device 16 are closed. Ambient pressure preferably prevails in the cylinder chambers 49, 52. In this operating state the spring 60 is also preferably compressed such that the valve body 57 rests on the limiting element 59. The spring 36 provides the force required to compress the spring 60.

The mode of operation of the inlet valve 1 during operation of the compressor will be described below with reference to FIGS. 1, 3 and 4, which show the inlet valve 1 in different operating states.

FIG. 1 shows the inlet valve 1 in a no-load operating state. The valve device 6 is in its closed operating state. The valve body 57 rests against the valve seat 56, preferably in a gas-tight manner. During no-load operation of the compressor, the second cylinder chamber 52 is deaerated, that is to say there is no gas pressure or merely ambient pressure therein. A valve 61 provided in the working pressure supply line 53 (FIG. 3), in particular a solenoid valve, which is suitable for putting the oil separation tank in fluid communication with the second cylinder chamber 52 via the working pressure supply line 53, is preferably closed. The valve 61 can alternatively be in the form of a pneumatic valve, as any electrically actuated valve or the like. The working pressure supply line 53 is deaerated via the valve 61.

Because the compressor already performs compression work in no-load operation, a negative pressure is produced in the gas outlet portion 4. Owing to the pressure difference between the gas inlet portion 3 and the gas outlet portion 4, a force $F_U$ acting in the direction of the gas outlet portion 4 against the spring force $F_F$ of the spring 36 acts on the valve body 57.

The gas pressure of the gas outlet portion 4 basically also prevails in the first cylinder chamber 49 owing to the operative fluid communication between said gas outlet portion and the first cylinder chamber 49. The operative fluid communication between the gas outlet portion 4 and the first cylinder chamber 49 is implemented by the fluid line 39, the hole 48 and the transverse holes 55. As a result, a differential pressure is formed between the first cylinder chamber 49 and the inner space 33 of the housing 2, which pressure results in a force $F_O$ which acts upwards in the direction of the housing cover 24. The force $F_O$ preferably has the same direction of action as the spring force $F_F$. The diameter $D_{K1}$ of the first piston portion 43 and the sealing diameter $D_D$ and the active surfaces of the first piston portion 43 and of the valve body 57 are preferably adapted to one another in such a way that a force $F_R$ resulting from the forces $F_U$, $F_O$ and $F_F$ pushes the first piston portion 43 towards the housing cover 24 when the gas inlet valve 1 is in the no-load operating state. A minimum spacing between the first piston portion 43 and the housing cover 24 also remains when the first piston portion 43 is moved as far as possible towards the housing cover 24. The resulting force $F_R$ is preferably at least so great that the valve device 6 remains closed in no-load operation. A gas flow from the gas inlet portion 3 to the gas outlet portion 4 via the valve device 6 is prevented. In this case, the size of the active surface of the first piston portion 43 can be varied within certain limits, in particular by means of the diameter $D_{K1}$ of the first piston portion 43. A reduction of the active surface of the first piston portion 43 can be compensated by increasing the bias of the spring 36. In particular, the active surface of the first piston portion 43 and the active surface of the valve body 57 are dimensioned and/or adapted to each other such that the force $F_O$ acting on the first piston portion 43 and the spring force $F_F$ of the spring device 36 act against the force $F_U$ acting on the valve body 57, in such a way that the valve device 6 remains in its closed operating state when the second cylinder chamber 52 is deaerated. The valve device 6 can therefore be opened only by applying a control pressure to the second cylinder chamber 52. In particular, the control pressure for controlling the gas inlet valve 1, that is to say for opening the valve device 6, comes from a pressure side of the compressor, that is to say from the pressure space 54.

Owing to the prevailing differential pressure between the gas inlet portion 3 and the gas outlet portion 4, the valve piston 19 of the bypass device 16 is pressed in the direction of the screw plug 15 against the spring bias of the spring 20. As a result, fluid communication is provided between the gas inlet portion 3 and the gas outlet portion 4 by means of the stepped hole 13 and the hole 18, whereby gas can flow from the gas inlet portion 3, around the closed valve device 6, to the gas outlet portion 4. Preferably only a defined amount of gas can flow into the compressor block 5. The spring 20 is preferably designed or biased in such a way that the valve piston 19 is moved against the spring force of the spring 20 at a predetermined no-load differential pressure. The stepped hole 13, in particular a cross-section of the stepped hole 13, is configured in such a way that a defined amount of gas can flow into the compressor block 5 when the valve piston 19 is moved towards the screw plug 15. The gas flowing into the compressor block 5 is compressed and continuously supplied to the oil separation tank of the compressor, to which a gas pressure is therefore applied. In the no-load operating state, the oil separation tank is optionally deaerated by means of a ventilating valve into the environment 14 or more preferably into the inner space 33, in order to prevent an undesirable increase in the gas pressure in the oil separation tank. A sound absorber can be provided in the inner space 33, which sound absorber absorbs the sounds produced during venting of the gas pressure of the oil separation tank into the inner space 33. In the no-load operating state the spring 60 is preferably biased by the spring force $F_F$ and the force $F_O$, in particular in such a way that the valve body 57 rests on the limiting element 59.

Figure 3:
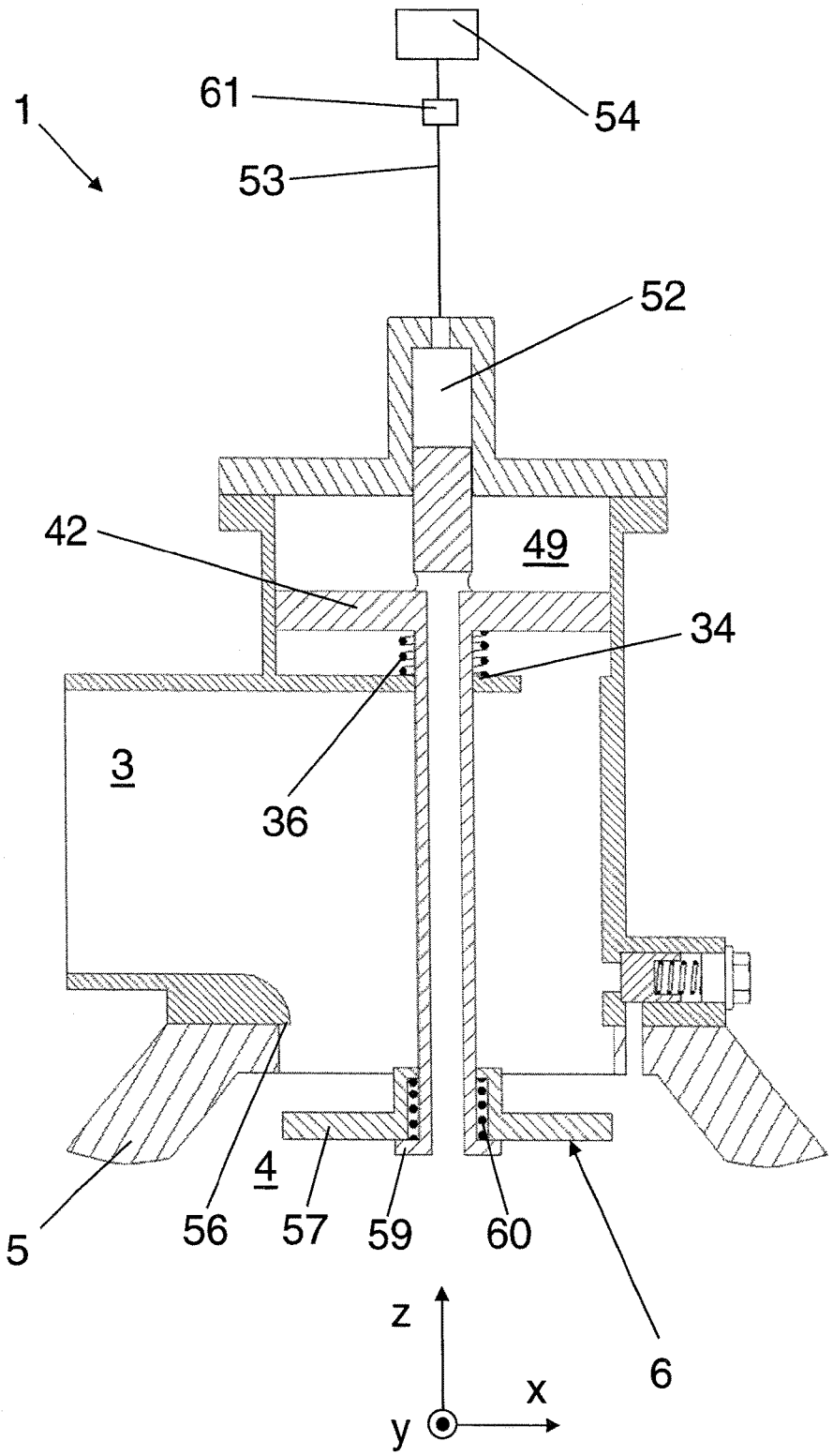
FIG. 3 is a cross-sectional view of the gas inlet valve according to FIG. 1 in a load operating state.

An operating state of the gas inlet valve 1 during load or full-load operation is shown in FIG. 3. When the valve 61 is opened, the gas pressure or working pressure prevailing in the oil separation tank is applied to the second cylinder chamber 52 via the working pressure supply line 53. The higher the working pressure in the second cylinder chamber 52 becomes, the further the piston device 42 is moved in the direction of the valve dome 34 against the spring force $F_F$ of the spring 36. As a result, the valve device 6 begins to open, that is to say the valve body 57 is lifted from the valve seat 56. Once the valve device 6 is opened, the same gas pressure preferably prevails in the gas inlet portion 3 and the gas outlet portion 4. Owing to the opening of the valve device 6, more gas flows into the compressor block 5, whereby the gas pressure in the oil separation tank and thus the working pressure in the second cylinder chamber 52 are increased. As a result, the piston device 42 is again moved further in the direction of the valve dome 34 until the valve device 6 is located in its completely open operating state shown in FIG. 3. When the valve device 6 is in its completely open operating state, the gas flows unhindered from the gas inlet portion 3 to the gas outlet portion 4. The spring 60 is preferably designed such that it is held under bias by the gas flowing through the valve device 6 in such a way that the valve body 57 continues to rest on the limiting element 59.

In a preferred development of the gas inlet valve 1, the valve 61 is designed as a proportional valve which controls the working pressure present in the second cylinder chamber 52 in a variable manner for the movement of the piston device 42. An opening gap, which the valve body 57 forms together with the valve seat 56 when lifted from the valve seat 56, can thus be changed as desired. The amount of gas flowing into the compressor block 5 or the flow rate of the compressor can thus be controlled. As a result, part-load operation of the gas inlet valve 1 is made possible.

Figure 4:
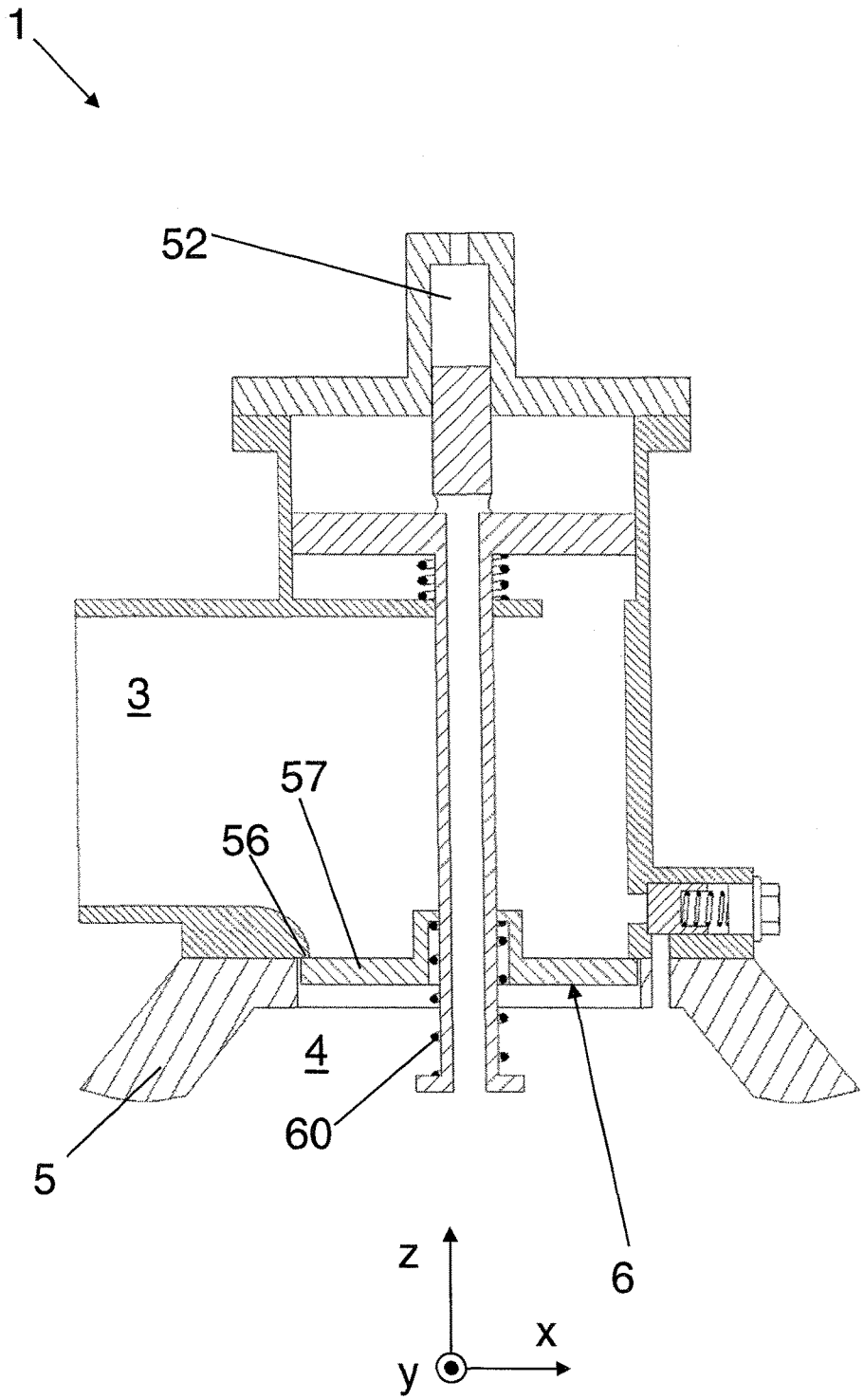
FIG. 4 is a cross-sectional view of the gas inlet valve according to FIG. 1 in a non-return position.

FIG. 4 shows the gas inlet valve 1 in a non-return position. If the compressor is stopped, for example owing to an emergency shutdown or a changeover into no-load operation, it takes a certain period of time for the entire system to be deaerated. This means that the working pressure in the second cylinder chamber 52 persists even though no more gas flows into the compressor. In addition, a pressure builds up in a time-delayed manner under the valve body 57 in the gas outlet portion 4 if the compression process is interrupted. The flow from the suction filter of the compressor through the gas inlet valve 1 towards the compressor block 5 breaks off. Before the gas flowing back reaches the valve body 57, the spring 60, to which a gas pressure from the gas inlet portion 3 is now no longer applied, has meanwhile already lifted said valve body almost to the valve seat 59. The spring 60 is preferably in an unstressed state. In this operating state the spring 60 can also be biased slightly by the dead weight of the valve body 57. When a non-return function sets in, that is to say when the returning gas reaches the valve body 57, the distance of the valve body 57 from the valve seat 59 in the z direction is relatively small. The impact forces when the valve body 57 hits the valve seat 56 thus prove to be accordingly small. As a result, excessive wear of the valve body 57 is prevented, thereby increasing the service life of the gas inlet valve 1.

The non-return function prevents gas from entering the gas inlet portion 3 through the valve device 6. In addition, relatively large amounts of pressurised gas are prevented from flowing from the oil separation tank into the compressor block 5 and rotating the compressor screws counter to their intended rotational direction. An oil-gas mixture could undesirably be conveyed into the gas inlet portion 3 as a result of this. The vale piston 19 for the no-load control system is pressed against the valve seat 17 owing to the same pressure ratios and the spring force of the spring 20 and thus reliably prevents pressurised gas from escaping through the bypass device 16.

In an alternative but equally preferred embodiment of the gas inlet valve 1, the bypass device 16 is implemented by means of transverse holes provided in the piston rod 38. In this embodiment of the bypass device 16, transverse holes, for example two transverse holes, are formed in the piston rod 38, which holes intersect in particular at an angle of 90° and penetrate the entirety of the piston rod 38 perpendicular to the central axis 10. The transverse holes cut in particular into the fluid line 39 of the piston rod 38. The transverse holes are formed in the piston rod 38 in particular in such a way that they open into the gas inlet portion 3 directly above the valve body 57 when the valve device 6 is in the closed operating state, that is to say when the gas inlet valve 1 is in the no-load state shown in FIG. 1. Thus, when the gas inlet valve 1 is in the no-load operating state according to FIG. 1, the gas inlet portion 3 is in fluid communication with the gas outlet portion 4 via the transverse holes and the fluid line 39.

If the compression process is stopped unexpectedly, the above-described non-return function of the valve body 57 sets in. In this case, the pressure present in the system must not suddenly be released via the gas inlet valve 1. The increasing pressure underneath the valve body 57 ensures that said valve body is pressed against the valve seat 56 and no gas and/or fluid can enter the gas inlet portion 3 via the valve device 6. Since the piston rod 38 remains in the position thereof shown in FIG. 4 owing to the working pressure present in the second cylinder chamber 52, the transverse holes in the piston rod 38 are covered by the valve body 57. Thus, in this development of the gas inlet valve 1 too, venting of the pressurised gas counter to the compression direction is not possible. This configuration of the bypass device 16 is particularly cost-effective to produce and economises on additional components.

In a further but equally preferred embodiment of the gas inlet valve 1, the bypass device 16 is implemented in such a way that a gap width of a gap between the outer surface 45 of the first piston portion 43 and the first cylinder portion 22 is calculated such that, via the gap, in the no-load operating state, a defined no-load gas quantity can be drawn from the gas inlet portion 3, around the closed valve device 6, and into the gas outlet portion 4. In the load operating state the gas pressure in the first cylinder chamber 49 and in the gas inlet portion 3 is substantially equal, and therefore no additional air is drawn in via the gap between the outer surface 45 and the first cylinder portion 22 in this operating state.

In another preferred configuration of the gas inlet valve 1, the spring 60 of the valve device 6 is arranged not between the limiting element 59 and the valve body 57 but rather in an annular groove provided in the housing 2 or in the compressor block 5.

Figure 5:
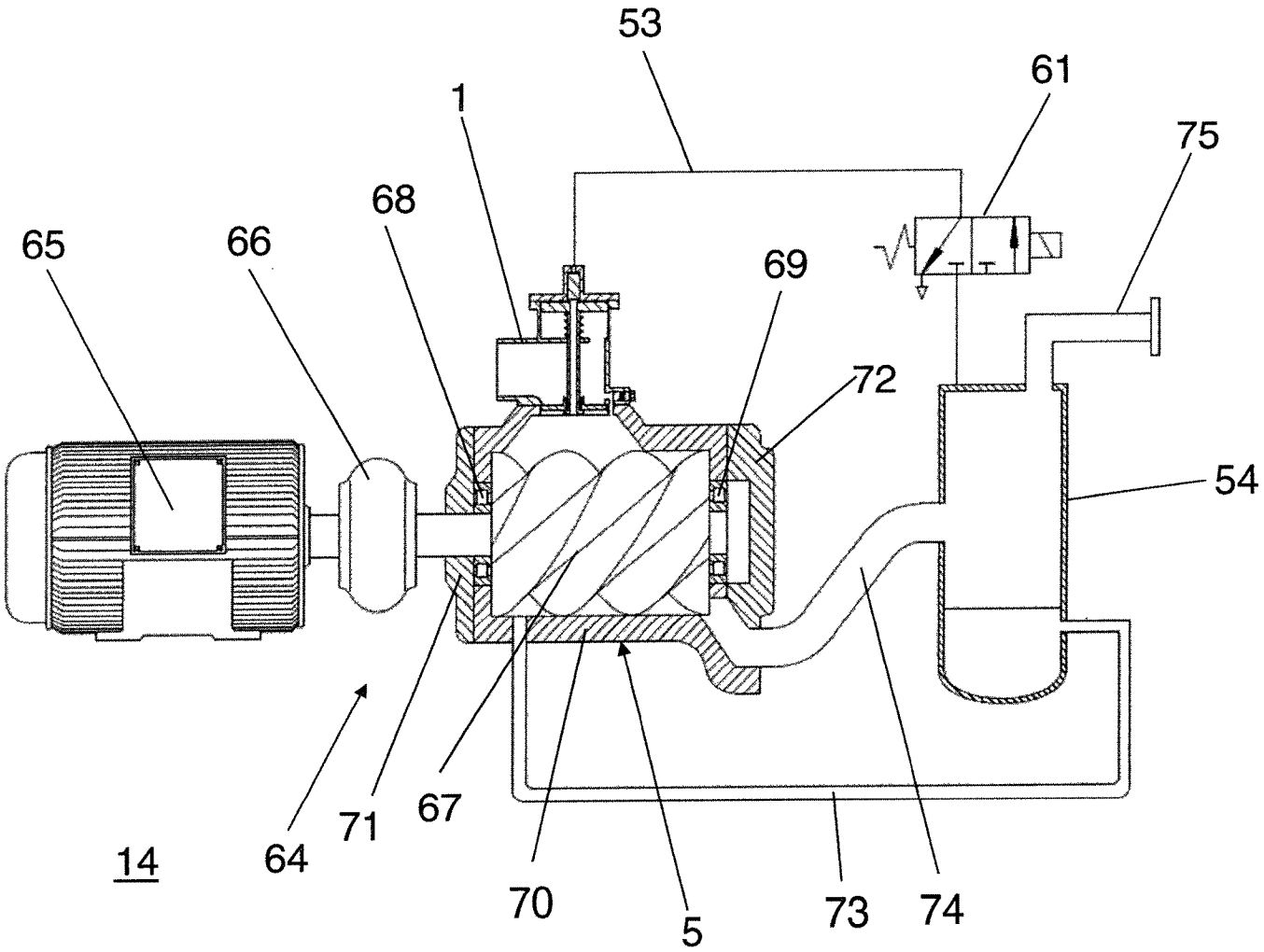
FIG. 5 is a cross-sectional view of a preferred embodiment of a compressor comprising a gas inlet valve according to FIG. 1.

FIG. 5 shows a preferred embodiment of a compressor 64, in particular a rotary compressor, comprising a gas inlet valve 1 of this type. The compressor 64 comprises a drive motor 65 which is operatively connected to compressor screws 67 of the compressor block 5 by means of a coupling device 66. The coupling device 66 is preferably designed as a gearing or as a transducer. In particular, the compressor block 5 comprises two compressor screws 67 which are rotatably mounted in the compressor block 5 by means of mounting devices 68, 69. The compressor block 5 preferably comprises a housing 70 which accommodates the compressor screws 67 and comprises two housing covers 71, 72 arranged at the ends thereof.

An oil injection device 73 puts the oil separation tank in fluid communication with the compressor block 5. The compressor screws 67 are lubricated by means of the oil injection device 73. The compressor block 5 is put in operative fluid communication with the oil separation tank by means of a gas supply line 74. The oil separation tank 74 is supplied preferably with a mixture of compressed gas and oil from the compressor block 5 by means of the gas supply line 74. The oil separation tank is also in operative fluid communication with the second cylinder chamber 52 of the gas inlet valve 1 by means of the working pressure supply line 53. The gas pressure, in particular working pressure, prevailing in the oil separation tank can be applied to the second cylinder chamber 52 in a switchable manner via the valve 61. The oil separation tank 54 can be connected to a compressed air network by means of a connection flange 75.

The mode of operation of the compressor 64 will be described below. When the compressor 64 is at a standstill there is no pressure in the compressor system. The valve 61, which is preferably designed as a solenoid valve, is open in a currentless state. The second cylinder chamber 52 is deaerated and connected to the environment 1 via the working pressure supply line 53. The gas inlet valve 1 is closed owing to the spring force $F_F$ of the spring device 36.

To bring the compressor 64 out of the standstill operating state and into a no-load operating state, a start command is firstly given by a control system of the compressor 64. The valve 61 initially remains currentless. The drive motor 65 preferably starts up in star connection. The drive motor 65 drives the compressor screws 67 via the coupling device 66. Since the valve body 57 is pressed against its valve seat 56 owing to the spring force $F_F$ of the spring device 36, a negative pressure is produced in the gas outlet portion 4 of the gas inlet valve 1. Since the first cylinder chamber 49 is in operative fluid communication with the gas outlet portion 4 by means of the fluid line 39 provided in the piston rod 38, this negative pressure also acts in the first cylinder chamber 49. Owing to the force ratios between the active surface of the first piston portion 43, on which the force $F_O$ acts, the active surface of the valve body 57, on which the force $F_U$ acts, and the spring device 36, which produces the force $F_F$, the valve body 57 remains in contact with the valve seat 56 and the valve device 6 thus remains closed.

Because there is a pressure difference between the gas inlet portion 3 and the gas outlet portion 4, the bypass device 16 is opened at a predetermined gas pressure. A small amount of gas can thus travel from the gas inlet portion 3, past the closed valve device 6 and into the gas outlet portion 4 via the bypass device 16. In the compressor block 5 the gas flowing via the bypass device 16 is compressed and supplied to the oil separation tank in a mixture with oil. In the oil separation tank there is thus a slight overpressure of approximately 1 bar. As a result the oil circuit comprising the oil injection device 73 for lubricating the compressor screws 67 is driven. After a predetermined period of time, for example after a few seconds, the drive motor 65 is switched from star to delta connection. The predetermined period of time is dependent on the type of compressor.

To switch from the no-load operating state to a full-load operating state of the compressor 64, the control system issues a load command, the valve 61 is supplied with current and isolates the working pressure supply line 53 from the oil separation tank to the second cylinder chamber 52. The gas pressure of the oil separation tank is now present in the second cylinder chamber 52 and acts against the spring force $F_F$ of the spring device 36. The valve device 6 is opened as a result. The valve device 6 is opened, that is to say the valve body 57 is lifted from its valve seat 56, for example immediately in full or gradually. The complete opening of the valve device 6 causes the negative pressure in the gas outlet portion 4 and in the first cylinder chamber 49 to decrease to approximately zero. The gas inlet valve 1 is completely open and the compressor 64 operates under full load.

When an upper set pressure of the compressor is reached, the compressor is switched from the full-load operating state back into the no-load operating state by means of the control system. In particular, this prevents what is known as a maximum connecting frequency of the motor (x times per second) from being exceeded. To switch into the no-load operating state, the valve 61 is disconnected from the current by means of the control system. The second cylinder chamber 52 is connected to the environment 14 via the working pressure supply line 53 and the second cylinder chamber 52 is deaerated. Owing to the force ratios between the active surface of the first piston portion 43, on which the force $F_O$ acts, and the active surface of the valve body 57, on which the force $F_U$ acts and which is preferably of a similar size to the active surface of the first piston portion 43, the spring force $F_F$ of the spring device 36 is sufficient for the valve device 6 to close.

In an operating state of part-load control, also referred to as modulating control or proportional control, the compressor 64 is controlled via a proportional controller in the range of approximately 10 to 100% of its flow rate. The proportional controller is preferably designed as what is known as a "negative controller". This means that, when the inlet pressure at the proportional controller increases, the outlet pressure thereof decreases, and vice versa. The gas inlet valve 1 can continuously be opened by variable, in particular increasing, inlet pressure. Depending on the compressed air requirement, a constant system outlet pressure is thus adjusted at the connection flange 75 of the compressor 64.

The gas inlet valve 1 described herein has many advantages in comparison with the prior art described in DE 602 10 088 T2. The fact that the piston device 42 comprises the first piston portion 43 and the second piston portion 44 which is different therefrom, the active surface of the second piston portion 44 being considerably smaller than the active surface of the first piston portion 43, provides, for the second piston portion 44, for example the advantages of smaller active frictional forces, smaller stick-slip effects and a reduced sealing diameter. In addition, the second cylinder chamber 52 of the gas inlet valve 1 described herein is considerably smaller in comparison with the prior art. Since this second cylinder chamber 52 must be relieved/deaerated in the case of switching processes, a smaller volume is advantageous. Owing to a small volume of the second cylinder chamber 52, a duration of the deaeration process can be kept short or, for the same deaeration duration, smaller line cross-sections can be selected.

In addition, in the known prior art, the control pressure of the oil separation tank assists the closing movement of the valve body, in particular when starting up the compressor and when switching from full load to no load. When the compressor is at a standstill, the gas inlet valve according to the prior art is in an open position owing to the gravity of the valve body. Even when the compressor is under full load, there is no control pressure at the gas inlet valve, that is to say, the gas inlet valve is open. It can be closed only by applying the control pressure. A leak or defect at one of the control lines or even a defect at one of the valves can result in the gas inlet valve according to the prior art no longer closing, and the compressor consequently no longer being able to switch to no-load operation. A possible consequence is a pressure increase beyond the compressor nominal pressure. In contrast to the prior art, the gas inlet valve 1 described herein is closed in a pressureless manner owing to the spring force $F_F$ of the spring device 36. The gas pressure of the oil separation tank 54 assists the opening of the valve device 6, that is to say the actuation of the gas inlet valve 1 when the compressor 64 is being switched from the no-load operating state to the full-load operating state.

In addition, the gas inlet valve 1 described herein is comparatively easy to control compared to the prior art. The gas inlet valve 1 can be controlled via the valve 61, which is preferably designed as a 3/2-port directional control valve. The following components in particular are not required for controlling the gas inlet valve 1 described herein: relief valve, nozzle and/or non-return valve. In addition, a single control line in the form of the working pressure supply line 53 is sufficient for controlling the gas inlet valve 1.

LIST OF REFERENCE SIGNS

1 gas inlet valve
2 housing
3 gas inlet portion
4 gas outlet portion
5 compressor block
6 valve device
7 first housing portion
8 block connection flange
9 screw-on surface
10 central axis
11 cast eye
12 central axis
13 stepped hole
14 environment
15 screw plug
16 bypass device
17 valve seat
18 hole
19 valve piston
20 spring

21 sealing portion
22 first cylinder portion
23 shoulder
24 housing cover
25 arched portion
26 connection flange
27 second cylinder portion
28 working pressure supply hole
29 second housing portion
30 central axis
31 flange portion
32 wall portion
33 inner space
34 valve dome
35 through-hole
36 spring device
37 aperture
38 piston rod
39 fluid line
40 first end portion
41 second end portion
42 piston device
43 first piston portion
44 second piston portion
45 outer surface
46 end face
47 connection portion
48 hole
49 first cylinder chamber
50 annular groove
51 sealing ring
52 second cylinder chamber
53 working pressure supply line
54 pressure space
55 transverse hole
56 valve seat
57 valve body
58 hole
59 limiting element
60 spring
61 valve
64 compressor
65 drive motor
66 coupling device
67 compressor screw
68 mounting device
69 mounting device
70 housing
71 housing cover
72 housing cover
73 oil injection device
74 gas supply line
75 connection flange
$D_D$ sealing diameter
$D_{K1}$ diameter
$D_{K2}$ diameter
$D_{Z1}$ diameter
$D_{Z2}$ diameter
$F_F$ force
$F_O$ force
$F_R$ force
$F_U$ force
$l_1$ length
$l_2$ length
x x direction
y y direction
z z direction
α angle

The invention claimed is:

1. A gas inlet valve for a compressor, comprising:

a housing which comprises a gas inlet portion for drawing in a gas and a gas outlet portion for conveying the drawn-in gas to a compressor block of the compressor, which gas outlet portion can be put in operative fluid communication with the gas inlet portion as needed;

a valve device which is arranged between the gas inlet portion and the gas outlet portion and comprises a valve body and a valve seat, the valve body resting against the valve seat in a sealing manner when the valve device is in a closed operating state, and the valve body being lifted from the valve seat when the valve device is in an open operating state;

a piston device which comprises a first piston portion and a second piston portion which is different from the first piston portion, the first piston portion being displaceably guided in a first cylinder portion of the housing and the second piston portion being displaceably guided in a second cylinder portion of the housing which is different from the first cylinder portion; and a piston rod which is displaceably mounted in the housing and mechanically couples the valve body of the valve device to the piston device, a fluid line putting a first cylinder chamber of the first cylinder portion in operative fluid communication with the gas outlet portion in such a manner that the first cylinder chamber is in operative fluid communication with the gas outlet portion via the fluid line in an operating state in which the valve body rests against the valve seat, it being possible to apply a control pressure to a second cylinder chamber of the second cylinder portion in order to lift the valve body from the valve seat, wherein an active surface of the first piston portion is larger than an active surface of the second piston portion and wherein the second piston portion is arranged on an end face of the first piston portion.

2. The gas inlet valve according to claim 1, wherein the piston rod comprises the fluid line, or wherein the fluid line is designed as a fluid conduit extending in the housing.

3. The gas inlet valve according to claim 1, wherein the gas inlet valve comprises a spring device which spring-biases the piston device in the direction of a housing cover of the housing.

4. The gas inlet valve according to claim 3, wherein the spring device is arranged between the piston device and a valve dome of the housing, the spring device spring-biasing the valve body against its valve seat via the mechanical coupling of the piston device and the valve body by means of the piston rod.

5. The gas inlet valve according to claim 1, wherein the gas inlet valve comprises a bypass device which puts the gas inlet portion in operative fluid communication with the gas outlet portion, bypassing the closed valve device, as needed.

6. The gas inlet valve according to claim 1, wherein the active surface of the first piston portion corresponds to 0.7 to 1.5 times an active surface of the valve body.

7. The gas inlet valve according to claim 1, wherein an active surface of the first piston portion and an active surface of the valve body are dimensioned in such a way that the valve device remains in its closed operating state when the second cylinder chamber is deaerated, irrespective of an operating state of the compressor, owing to forces acting on the first piston portion and the valve body and owing to a spring force of the spring device acting on the valve body and that the valve device can be opened only by applying the control pressure to the second cylinder chamber.

8. The gas inlet valve according to claim 1, wherein the valve body is displaceably mounted on the piston rod.

9. The gas inlet valve according to claim 1, wherein the valve device comprises a spring which is arranged between the valve body and a limiting element of the piston rod.

10. The gas inlet valve according to claim 9, wherein the spring is designed to carry a dead weight of the valve body.

11. A compressor comprising a gas inlet valve according to claim 1.

12. The gas inlet valve according to claim 1, wherein the gas inlet valve is a gas inlet valve for a rotary compressor.

13. The gas inlet valve according to claim 1, wherein the piston rod comprises the fluid line, the fluid line configured as a fluid conduit extending in the piston rod.

14. The gas inlet valve according to claim 5, wherein the bypass device puts the gas inlet portion in operative fluid communication with the gas outlet portion, bypassing the closed valve device, as needed, when the gas inlet valve is in a no-load operating state.

15. The gas inlet valve according to claim 5, wherein the bypass device is designed to operate according to the operating principle of a non-return valve.

16. The gas inlet valve according to claim 1, wherein the active surface of the first piston portion is at least 15 times larger than the active surface of the second piston portion.

17. The gas inlet valve according to claim 1, wherein the active surface of the first piston portion corresponds to 1 to 1.1 times an active surface of the valve body.

18. The compressor according to claim 11, wherein the compressor is a rotary compressor.

19. The gas inlet valve according to claim 1, wherein the fluid line is designed as a fluid conduit extending in a wall of the housing.

* * * * *